US008651150B2

(12) United States Patent
Siebert

(10) Patent No.: US 8,651,150 B2
(45) Date of Patent: Feb. 18, 2014

(54) METHOD FOR SIMULTANEOUSLY WEAVING TWO FABRICS, FABRIC ADAPTED TO BE WOVEN WITH SUCH A METHOD AND LOOM USABLE WITH SUCH A METHOD

(75) Inventor: Karsten Siebert, Weidenberg (DE)

(73) Assignee: Schonherr Textilmaschinenbau BMBH, Chemnitz (DE)

( * ) Notice: Subject to any disclaimer, the term of this patent is extended or adjusted under 35 U.S.C. 154(b) by 154 days.

(21) Appl. No.: 13/319,352

(22) PCT Filed: May 10, 2010

(86) PCT No.: PCT/FR2010/056386

§ 371 (c)(1),
(2), (4) Date: Nov. 8, 2011

(87) PCT Pub. No.: WO2010/130695

PCT Pub. Date: Nov. 18, 2010

(65) Prior Publication Data

US 2012/0190257 A1 Jul. 26, 2012

(30) Foreign Application Priority Data

May 13, 2009 (DE) ..... 09160163

(51) Int. Cl.
*D03C 13/00* (2006.01)
*D03D 39/16* (2006.01)
*D03D 39/00* (2006.01)

(52) U.S. Cl.
USPC ..... 139/21; 139/11; 139/20; 139/37; 139/391; 139/405

(58) Field of Classification Search
USPC ..... 139/11, 20, 21, 37–44, 46, 47, 391, 139/402, 403, 404, 405
See application file for complete search history.

(56) References Cited

U.S. PATENT DOCUMENTS 2,060,502 A * 11/1936 Kaufman ..... 139/398
2,108,046 A * 2/1938 Drobile ..... 139/397
2,599,293 A * 6/1952 Symonds ..... 139/37

(Continued)

FOREIGN PATENT DOCUMENTS

BE 1007679 A5 9/1995
CN 101387028 3/2009
EP 1347087 A2 9/2003
EP 1347087 A3 9/2003

*Primary Examiner* — Bobby Muromoto, Jr.
(74) *Attorney, Agent, or Firm* — Dowell & Dowell, PC

(57) ABSTRACT

This method, for simultaneously weaving on a loom two fabrics (42, 44) provided with piles (424, 444), comprises the steps of weaving an inner layer (FL2, FL4) and an outer layer (BL2, BL4) for each distance fabric, binding the inner and outer layers with connecting warp yarns (401-404) extending between the inner and outer layers, weaving pile warp yarns (501, 502) between the distance fabrics, and cutting the pile yarns. During weaving, the inner and outer layers of each distance fabric are kept apart by respective lancet means (202, 204). Moreover, for each pick (P1-P13) and for each connecting warp yarn (401-404) and each pile warp yarn (501, 502), one selects on the basis of the information relating to the layer (BL2, FL2, BL4, FL4) in which said warp yarn has been interlaced in the previous pick, on the basis of the shedding pattern and amongst several predetermined positions, a position (A1-A8, B1-B12) to be taken by a shedding element (10) driving said warp yarn (401-404, 501, 502) during said pick.

12 Claims, 7 Drawing Sheets

(56) References Cited

U.S. PATENT DOCUMENTS

| | | | | |
|---|---|---|---|---|
| 2,731,985 | A * | 1/1956 | Hoeselbarth | 139/39 |
| 2,750,964 | A * | 6/1956 | Hoeselbarth | 139/39 |
| 3,289,706 | A * | 12/1966 | Valentine | 139/21 |
| 3,394,739 | A * | 7/1968 | Crenshaw et al. | 139/21 |
| 3,727,645 | A * | 4/1973 | Jowett | 139/40 |
| 5,154,208 | A * | 10/1992 | Carlos | 139/37 |
| 5,400,831 | A * | 3/1995 | Gheysen | 139/21 |
| 5,615,712 | A * | 4/1997 | Derudder et al. | 139/21 |
| 5,655,573 | A * | 8/1997 | Gheysen et al. | 139/21 |
| 6,092,562 | A * | 7/2000 | Debaes | 139/398 |
| 6,192,943 | B1 * | 2/2001 | Griffith | 139/47 |
| 6,234,212 | B1 * | 5/2001 | Griffith | 139/47 |
| 6,457,490 | B2 * | 10/2002 | Dewispelaere et al. | 139/391 |
| 6,817,383 | B2 * | 11/2004 | Debaes et al. | 139/21 |
| 6,837,274 | B2 * | 1/2005 | Debaes et al. | 139/21 |
| 7,111,647 | B2 * | 9/2006 | Debaes | 139/21 |
| 7,134,401 | B2 * | 11/2006 | Debaes et al. | 116/21 |
| 7,240,698 | B2 * | 7/2007 | Debaes | 139/37 |
| 7,451,786 | B2 * | 11/2008 | Debaes | 139/21 |
| 7,520,303 | B2 * | 4/2009 | Mertens et al. | 139/21 |
| 7,621,297 | B2 * | 11/2009 | Debaes | 139/21 |
| 2001/0010236 | A1 * | 8/2001 | Dewispelaere et al. | 139/391 |
| 2001/0050112 | A1 * | 12/2001 | Smissaert | 139/383 A |
| 2002/0036021 | A1 * | 3/2002 | Goessl et al. | 139/2 |
| 2003/0226613 | A1 * | 12/2003 | Debaes et al. | 139/408 |
| 2004/0084101 | A1 * | 5/2004 | Debaes | 139/2 |
| 2004/0221910 | A1 * | 11/2004 | Debaes | 139/11 |
| 2004/0221915 | A1 * | 11/2004 | Debaes et al. | 139/409 |
| 2005/0109416 | A1 * | 5/2005 | Debaes et al. | 139/37 |
| 2005/0183787 | A1 * | 8/2005 | Debaes | 139/11 |
| 2005/0247367 | A1 * | 11/2005 | Debaes et al. | 139/327 |
| 2006/0118196 | A1 * | 6/2006 | Debaes | 139/11 |
| 2007/0006932 | A1 * | 1/2007 | Mertens et al. | 139/37 |
| 2007/0237921 | A1 | 10/2007 | Knapp | |
| 2008/0053557 | A1 * | 3/2008 | Debaes | 139/404 |
| 2008/0115852 | A1 * | 5/2008 | Debaes | 139/21 |
| 2012/0190257 | A1 * | 7/2012 | Siebert | 442/239 |
| 2013/0019987 | A1 * | 1/2013 | Beauduin | 139/21 |

* cited by examiner

METHOD FOR SIMULTANEOUSLY WEAVING TWO FABRICS, FABRIC ADAPTED TO BE WOVEN WITH SUCH A METHOD AND LOOM USABLE WITH SUCH A METHOD

This invention relates to a method for simultaneously weaving two distance fabrics. A distance fabric is a fabric comprising two layers of woven yarns separated by an empty space. In some particular cases, this space can be filled in with different materials, such as a particulate material. Such a distance fabric is sometimes qualified as "three-dimensional structure" and is particularly adapted to be used as artificial turf for sport grounds.

A woven artificial turf is known from WO-A-2007/116290 and includes pile yarns which extend, on two respective heights, from a base layer. This artificial turf can be woven on a face-to-face carpet loom. During weaving, some loops are provided to help the piles to stay upright. These loops provide poor elasticity of the turf.

On the other hand, BE-A-1007679 discloses a method for weaving two fabrics having each an inner layer which faces the other fabric during weaving and an outer layer. Connecting warp yarns extend between the inner and outer layers and bind them together. The pattern of those connecting yarns is quite simple since the associated shedding system provides only two positions. Pile warp yarns are interlaced in both inner layers. The required shedding system can provide three positions with respect to both inner weft insertion zones. Since they are interlaced in the inner layers, pile yarns are not held strongly enough for flooring applications. Connecting layer yarn consumption and yarn density are high, in particular on the inner layer of each fabric. This makes it difficult to introduce between the layers of each fabric a particulate material such as sand or rubber granulates. Therefore, such a fabric would not be appropriate to be used as an artificial turf.

The invention aims at solving these problems with a new method which makes it possible to simultaneously weave two distance fabrics with high productivity. Their structure can be sophisticated but still easy to produce. Such fabrics can be used as artificial turf or for other purposes.

This invention concerns a method for simultaneously weaving two fabrics provided with piles, said method comprising at least the steps of:

- weaving an inner layer and an outer layer for each distance fabric;
- binding the inner and outer layers with connecting warp yarns extending between the inner and outer layers;
- weaving pile warp yarns between the distance fabrics; and
- cutting the pile yarns;
- wherein
- during weaving, the inner and outer layers of each distance fabric are kept apart by respective lancet means; and
- for each pick and for each connecting warp yarn and each pile warp yarn, one selects, on the basis of the information relating to the layer in which said warp yarn has been interlaced in the previous pick, on the basis of the shedding pattern and amongst several predetermined positions, a position to be taken by a shedding element driving said warp yarn during said pick.

Thanks to the invention, "three dimensional structures" are no more limited to simple structures since it is possible to manage the shedding elements to take into account on one side geometrical information such as distance from beating points and insertion zones and on the other side patterning information. In particular, two distance fabrics can be manufactured with a high productivity and the connecting warp yarns can efficiently bind the inner and outer layers of each fabric, while they do not lower the elasticity of the fabrics and do not hinder filling of the space between the two layers of each fabric with a particulate material. Moreover, the pile warp yarns can be securely anchored to some layers of the fabrics and participate to the global elasticity of the fabrics.

According to advantageous but non compulsory aspects, a method according to the invention can incorporate one or several of the following features:

- The position is selected amongst a number of possible positions equal to M×(N+1), where M is the number of layers where the warp yarn is to be interlaced according to the shedding pattern and N is the number of weft insertion means used to insert weft yarns into the M layers.
- The connecting warp yarns are W inwoven successively in each layer of the distance fabric they belong to.
- In each distance fabric, connecting warp yarns are divided into two groups of warp yarns which alternate, on the same pick, between the inner and outer layers of the distance fabric.
- The pile warp yarns extend between the outer layers of the distance fabrics.
- The pile warp yarns are W inwoven in the outer layer of each distance fabric.
- Some pile yarns cross from one distance fabric to the other distance fabric over one pick.
- The pile warp yarns are divided into two groups of warp yarns which alternate, on the same pick, between the outer layer of the first distance fabric and the outer layer of the second distance fabric.
- Groups of connecting warp yarns and groups of pile warp yarns alternate on the same pick respectively between the inner and outer layers of each distance fabric and between the outer layers of the distance fabrics
- Three weft yarns are inserted in each pick, in such a way that in a given pick, a weft yarn is inserted in the outer layer of each distance fabric and in the inner layer of a first distance fabric, and in the next pick, a weft yarn is inserted in the outer layer of each distance fabric and in the inner layer of the second distance fabric.

The invention also concerns a fabric which can be woven with the method mentioned here-above and, more particularly, a fabric comprising a woven front layer, a woven back layer, connecting yarns extending between the front and back layers and pile yarns protruding from the front layer wherein the pile warp yarns are at least interlaced into the back layer of the fabric and go through its front layer.

According to advantageous aspects of the invention, such a fabric can incorporate one or several of the following features:

- Pile yarns are W inwoven in the back layer and/or connecting yarns are W inwoven successively in each layer of the fabric.
- The fabric is woven with synthetic yarns and forms an artificial turf.
- The piles of the fabric have at least two different lengths.

According to another aspect, the invention also concerns a loom which can be used to perform the method mentioned here-above in order to produce the fabric mentioned here-above. Such a loom is for simultaneously weaving two fabrics provided with an inner layer, an outer layer, connecting warp yarns extending between the inner and outer layers and pile yarns extending between the fabrics. This loom comprises, or is connected to, shed forming means and weft insertion means. According to the invention, the loom further comprises two sets of lancet means adapted to keep the inner and outer layers of each fabric apart from each other during weaving and said loom further comprises computation means adapted to select, for each pick and for each connecting warp yarn and each pile warp yarn, on the basis of the information relating to the layer in which said warp yarn has been interlaced in the previous pick, on the basis of the shedding pattern and amongst several predetermined positions, a position to be taken by a shedding element driving said warp yarn during said pick, where said warp yarn does not interfere with said weft insertion means.

The invention will be better understood on the basis of the following description which is given in correspondence with the annexed figures and as an illustrative example, without restricting the object of the invention. In the annexed figures.

Figure 1:
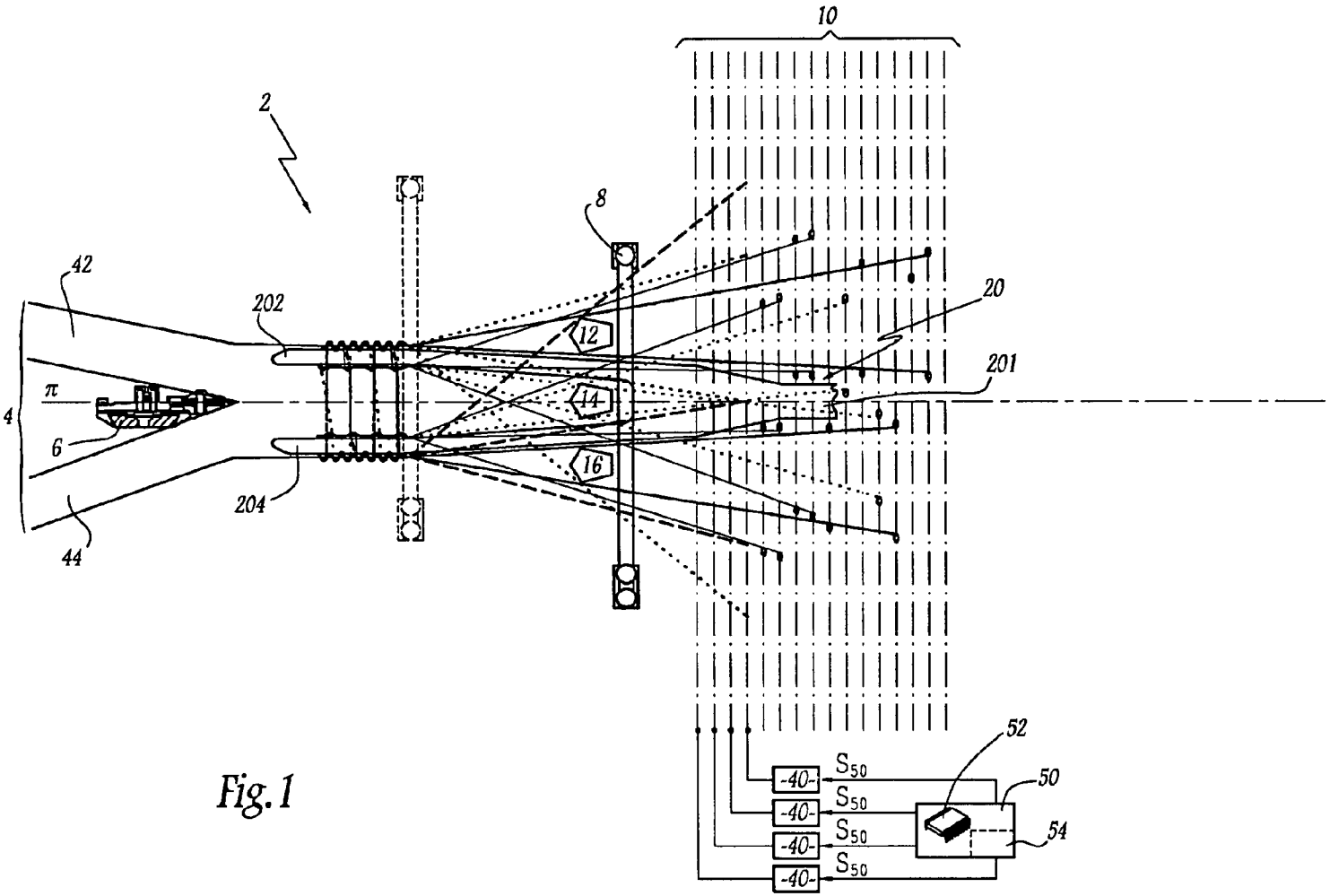
FIG. 1 is a schematic view of a loom according to the invention used to implement the method of the invention and to produce two fabrics of the invention.

A face-to-face three rapier sets loom 2 is represented on FIG. 1 and used to produce a double carpet 4 particularly adapted to be used as artificial turf. Carpet 4 is made of an upper distance fabric 42 and a lower distance fabric 44 which are separated, after weaving, by a cutting device 6 which cuts piles extending between the two fabrics. Loom 2 also includes a reed 8 which can be moved between the position represented in full lines and the position represented in dashed lines on FIG. 1. Loom 2 also includes sixteen heddle frames 10 which are moved by electric servomotors 40, such as the ones disclosed in EP-A-1 489 208. On FIG. 1, only four servomotors 40 are represented, for the sake of clarity. All servomotors are controlled by an electronic control unit 50 which includes computation means, in the form of a microchip 52, and a memory 54 accessible by microchip 52.

Three sets of rapiers, comprising respectively a bringer and a taker, are used in loom 2, namely a top rapier set 12, an intermediate rapier set 14 and a bottom rapier set 16.

Frames 10 are driven by their respective servomotors in order to bring the warp yarns into respective positions where they participate to the shed and do not interfere with the rapier sets 12-14-16 during insertion. Each frame 10 forms thus a shedding element for loom 2.

A double lancet 20 is introduced in each reed space and comprises a main rod 201, an upper finger 202 and a lower finger 204. Parts 201, 202 and 204 are integral with each other. Lancets 20 are distributed on the width of loom 2.

Figure 2:
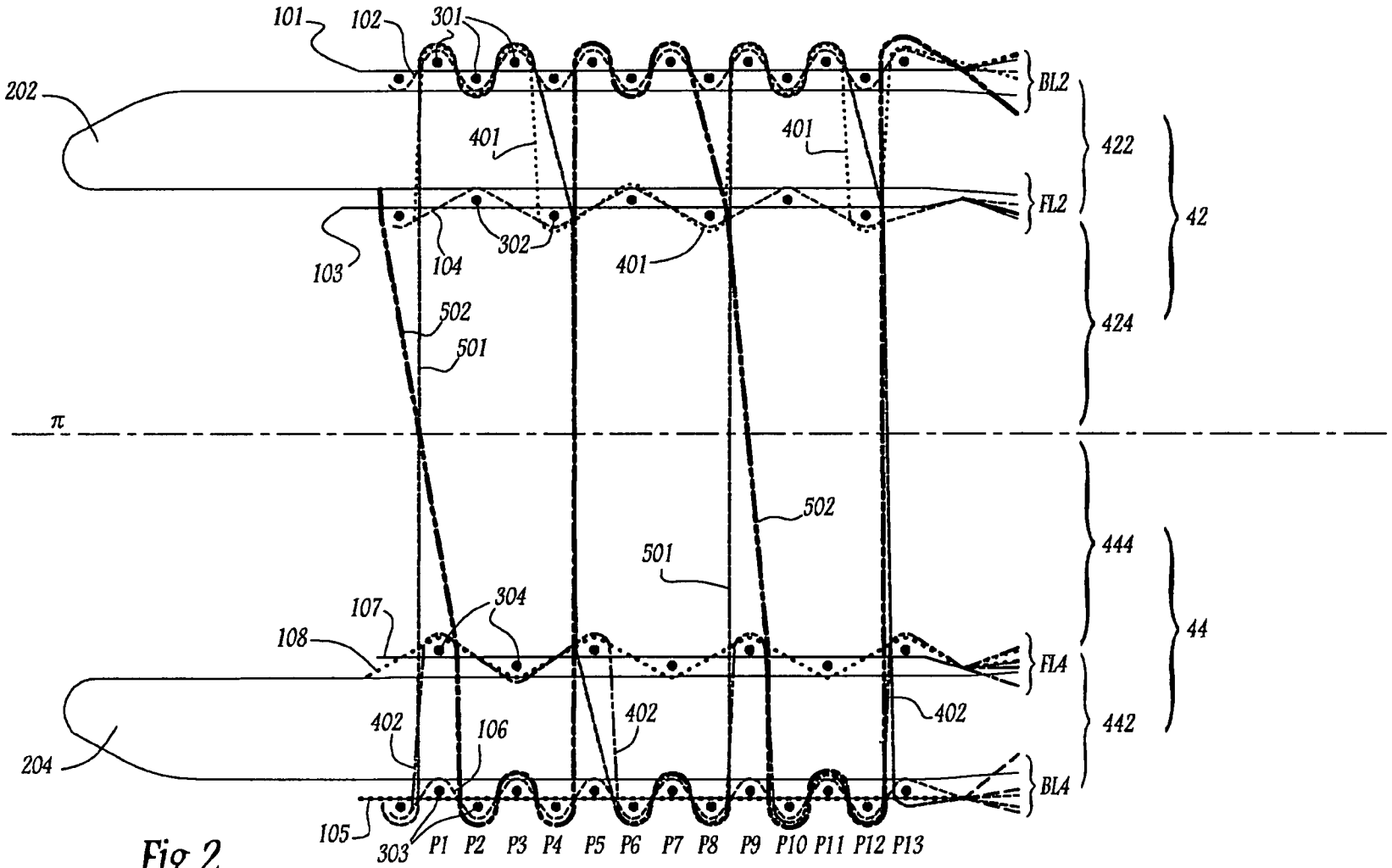
FIG. 2 is a schematic view showing the repartition of the warp and weft yarns in the loom of FIG. 1 during successive picks.

As shown on FIG. 2, upper fabric 42 comprises a top ground part 422 and a set of piles 424 extending from ground part towards lower fabric 44. Lower fabric 44 comprises a bottom ground part 442 and a set of piles 444 extending from ground part 442 towards upper fabric 42.

The shape of the lancets 20 is such that the intermediate rapier set 14 can travel between the respective fingers 202 and 204 of each lancet, without interference.

Top ground part 422 comprises a back layer BL2 and front layer FL2. Similarly, bottom ground part 442 comprises a back layer BL4 and a front layer FL4. Back and front layers are separated by an empty space in each fabric. Back layers BL2 and BL4 are woven externally with respect to fingers 202 and 204, whereas front layers FL2 and FL4 face each other in a center part of loom 2 defined between fingers 202 and 204 of the respective lancets 20. Therefore, back layers BL2 and BL4 form outer layers, whereas front layers FL2 and FL4 form inner layers of upper and lower fabrics 42 and 44. The pile set 424 and 444 extend between inner layers FL2 and FL4.

In the present description, the terms "outer" and "inner", "external" and "internal", "externally" and "internally" are defined with respect to a central plane $\pi$ of loom 2 which lies between fingers 202 and 204 and includes the cut line of cutting device 6. An object is "internal" or "inner" with respect to another item when it is closer to plane $\pi$ as this item. Conversely, an object is "external" or "outer" when it is further away from plane $\pi$ with respect to another item.

Three insertion zones are provided in loom 2 for rapier sets 12, 14 and 16 and they are located symmetrically with respect to a plane $\pi$, the insertion zone for set 14 being centered on this plane.

In the example, fabrics 42 and 44 are used as artificial turf and all yarns constituting these fabrics are synthetic, e.g. made of polyethylene because of its low coefficient of friction.

Outer or back layer BL2 comprises a filling warp yarn 101 and a binding warp yarn 102 which are woven with outer weft yarns 301 introduced within the shed, at every pick, by top rapier set 12, regularly under and above yarn 101 and above and under yarn 102.

Inner or front layer FL2 comprises a filling warp yarn 103 and a binding warp yarn 104 woven with inner weft yarns 302 which are introduced within the shed by intermediate rapier set 14, at every second pick.

FIG. 2 shows thirteen picks P1 to P13 of the method of the invention. The pick represented on the left of this figure is not referenced since it does not show all yarns. Inner weft yarns 302 are used to weave front layer FL2 for even picks (picks P2, P4, . . . ) and they are regularly distributed above and under filling warp yarns 103.

A connecting warp yarn 401 extends between inner and outer layers FL2 and BL2 in order to bind these layers. The connecting warp yarn 401 is woven according to 12 pick repeat.

At pick P1, connecting warp yarn 401 goes externally with respect to outer weft yarn 301. At pick P2, connecting warp yarn 401 goes internally with respect to outer weft yarn 301, that is under this yarn in the representation on FIG. 2. At pick P3, yarn 401 goes externally, that is above in the representation on FIG. 2, with respect to outer weft yarn 301. In other words, connecting warp yarn 401 follows a W-shaped path within outer layer BL2 between picks P1 and P3. Then, connecting warp yarn 401 moves from back layer BL2 to front layer FL2 and goes internally with respect to inner weft yarn 302, at pick P4. Then, connecting yarn 401 alternates between above a weft yarn 302 and under a weft yarn 302 on FIG. 2, that is externally and internally, between picks P4 and P8.

At pick P9, connecting warp yarn 401 moves back to outer layer BL2 and goes externally with respect to weft yarn 301. At pick 10, yarn 401 goes internally with respect to weft yarn 301 and, at pick 11, it goes externally with respect to weft yarn 301. At pick 12, connecting warp yarn 401 moves back to front layer FL2. At pick 13, connecting warp yarn 401 moves back to outer layer BL2 and recover the position of pick 1.

In other words, connecting warp yarn 401 follows a W-shaped path within back layer BL2, during picks 1, 2 and 3, 9, 10 and 11. On the other hand, connecting warp yarn follows a W-shaped path within front layer FL2 during picks 4, 6 and 8. The density of the path of warp yarn 401 in inner layer FL2 is lower than its density in outer layer BL2, since inner weft yarns 302 are woven only on every second pick within front layer FL2.

Similarly, outer or back layer BL4 includes a filling warp yarn 105 and a binding warp yarn 106 whereas front layer FL4 includes a filling warp yarn 107 and a binding warp yarn 108.

Outer weft yarns 303 are introduced within the shed corresponding to back layer BL4 by bottom rapier set 16 at each pick, whereas inner weft yarns 304 are introduced within front layer FL4 at every second pick, odd picks in the example in FIG. 2. These inner weft yarns 304 are introduced within the shed by intermediate rapier set 14. Actually, rapier set 14 introduces an inner weft yarn 302 in the inner layer FL2 of upper fabric 42 at one pick and an inner weft yarn 304 in the inner layer FL4 of lower fabric 44 on the next pick. In other words, it is possible to use three rapiers sets to constitute four layers, namely outer layers BL2 and BL4 with weft yarns 301 and 303 introduced at each pick and inner layers FL2 and FL4 with weft yarns 302 and 304 introduced alternatively at every second pick.

A second connecting warp yarn 402 is used to bind inner and outer layers FL4 and BL4 in a way similar to yarn 401. More precisely, connecting warp yarns 402 follows a W-shaped path within inner layer FL4 between picks P1 and P5, by going around, alternatively externally and internally, inner weft yarns 304. Then, warp yarn 402 goes from inner layer FL4 to outer layer BL4 where it follows a W-shaped path, around outer weft yarns 303, at picks P6, P7 and P8, before going back to front layer FL4. At pick 10, connecting warp yarn 402 goes back to outer layer BL4 where it follows a W-shaped path around outer weft yarns 303, at picks P10, P11 and P12.

Therefore, connecting warp yarns 401 and 402 can be said to be W-inwoven within inner and outer layers FL2, FL4, BL2 and BL4, which guarantees that these yarns efficiently hold together the layers of each fabric 42 and 44, these fabrics being qualified as "distance fabrics" insofar as their respective front and back layers can be kept at a distance.

In the meaning of the invention, a warp yarn is "W inwoven" in a layer when it is interlaced with at least three adjacent weft yarns in the same layer. This is the case when a warp yarn follows a W-shaped path with the adjacent weft yarns in the same layer. More precisely, when considering three adjacent weft yarns, the warp yarn goes externally with respect to the two extreme weft yarns and internally with respect to the intermediate weft yarn or internally with respect to the two extreme weft yarns and externally with respect to the intermediate weft yarn. In the meaning of the invention, a warp yarn is also "W inwoven" in a layer when it is interlaced with five adjacent weft yarns in the same layer. For five adjacent weft yarns, the warp yarn goes externally with respect to the first, third and fifth weft yarns and internally with respect to the second and fourth weft yarns or internally with respect to the first, third and fifth yarns and externally with respect to the second and fourth yarns.

Pile warp yarns also belong to fabrics 42 and 44. A first pile warp yarn 501 goes externally around outer weft yarn 301 at pick P1 and follows the same W-shaped path as yarn 401 within back layer BL2 at picks P1, P2 and P3. At pick P4, pile warp yarn 501 moves from back layer BL2 to front layer FL2 and goes between weft yarns 301 and 302. At pick P5, pile yarn 501 goes between weft yarns 303 and 304. At picks P6, P7 and P8, pile yarn 501 follows a W-shaped path within back layer BL4. Between picks P8 and P9, pile warp yarn 501 crosses inner layers FL4 and FL2 and reaches, at pick 9, the same configuration as at pick P1. In other words, pile war yarn 501 is W-inwoven in back layers BL2 and BL4 whereas it goes through layers FL2 and FL4, when it changes from one fabric to the other.

Another pile warp yarn 502 is represented on FIG. 2 and follows a W-shaped path within back layer BL4 at picks P2, P3 and P4, before going directly to back layer BL2 in order to follow a W-shaped path, in this layer, at picks 5, 6 and 7. Then, pile warp yarn 502 moves from back layer BL2 to back layer BL4 at picks P8 and P9. More precisely, pile warp yarn 502 goes between weft yarns 301 and 302 at pick P8 and internally with respect to weft yarn 304 at pick P9 before starting a new W-shaped path within back layer BL4 at picks P10, P11 and P12. Here again, pile warp yarns 501 and 502 are W-inwoven in the outer or back layers BL2 and BL4 which ensures firm anchoring of these yarns with respect to these layers, whereas these pile warp yarns regularly go through the volume between the inner and outer layer of each fabric.

Figure 6:
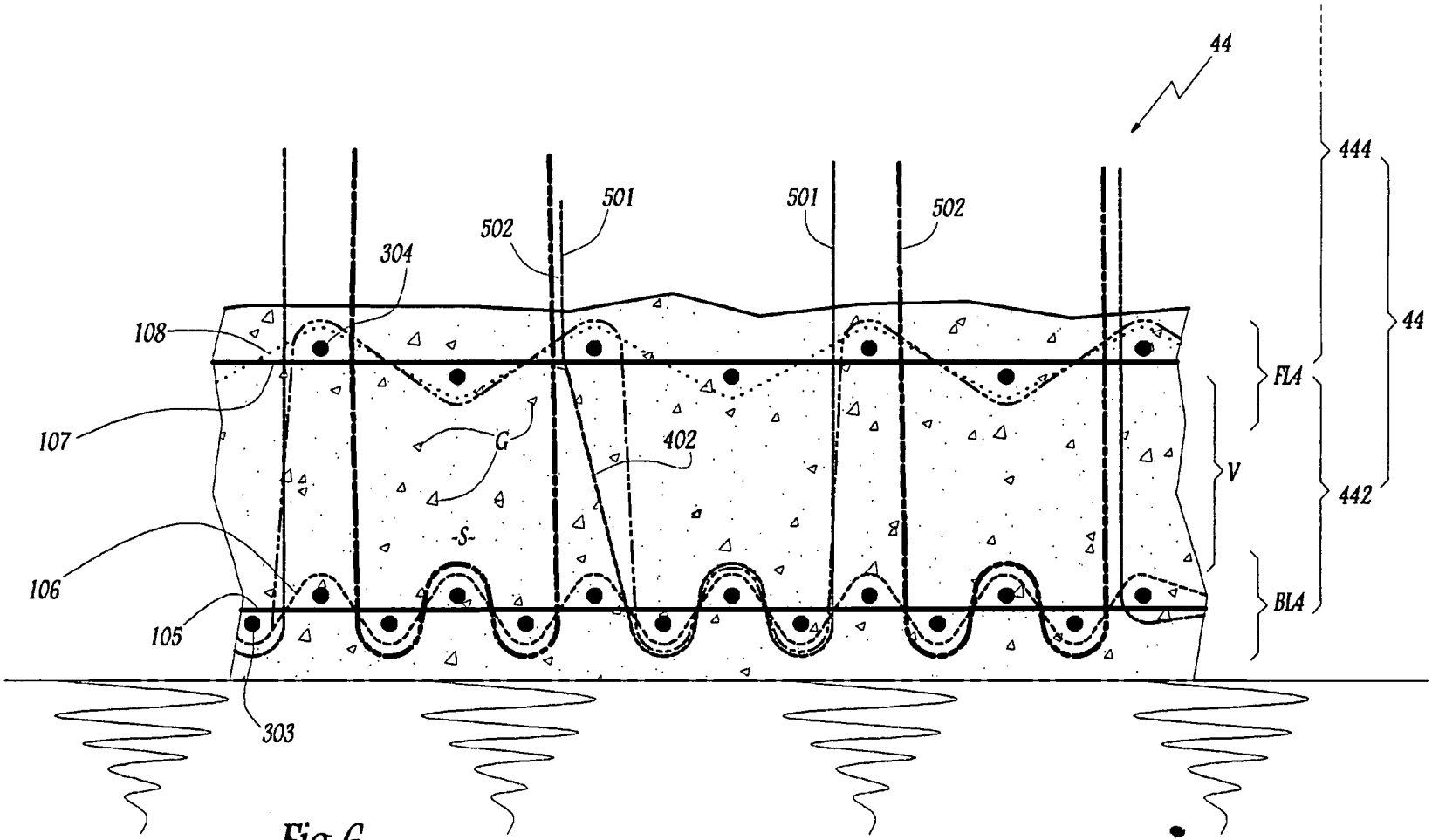
FIG. 6 represents a part of an artificial turf made of a fabric according to the invention.

When a fabric according to the invention is used as an artificial turf as shown on FIG. 6 for fabric 44, the volume V between its back layer BL4 and its front layer FL4 can be filled with sand S and/or rubber granulates G which provides some elasticity when somebody walks onto the fabric. The front layer FL4 can move with respect to the back layer BL4 in an elastic way thanks to the deformation of connecting yarn 402. Since the pile warp yarns 501 and 502 also go through the volume V, they also participate to the elasticity of the fabric, which is advantageous.

The pile warp yarns are moved between their respective positions represented on FIG. 2 by the first four heddle frames 10 represented on FIG. 1, that is the heddle frames which are closer to reed 8. Each heddle frame 10 is driven by one dedicated servomotor 40 controlled by electronic control unit 50. As shown on FIG. 2, the pile warp yarns are woven according to an eight picks repeat pattern.

Figure 3:
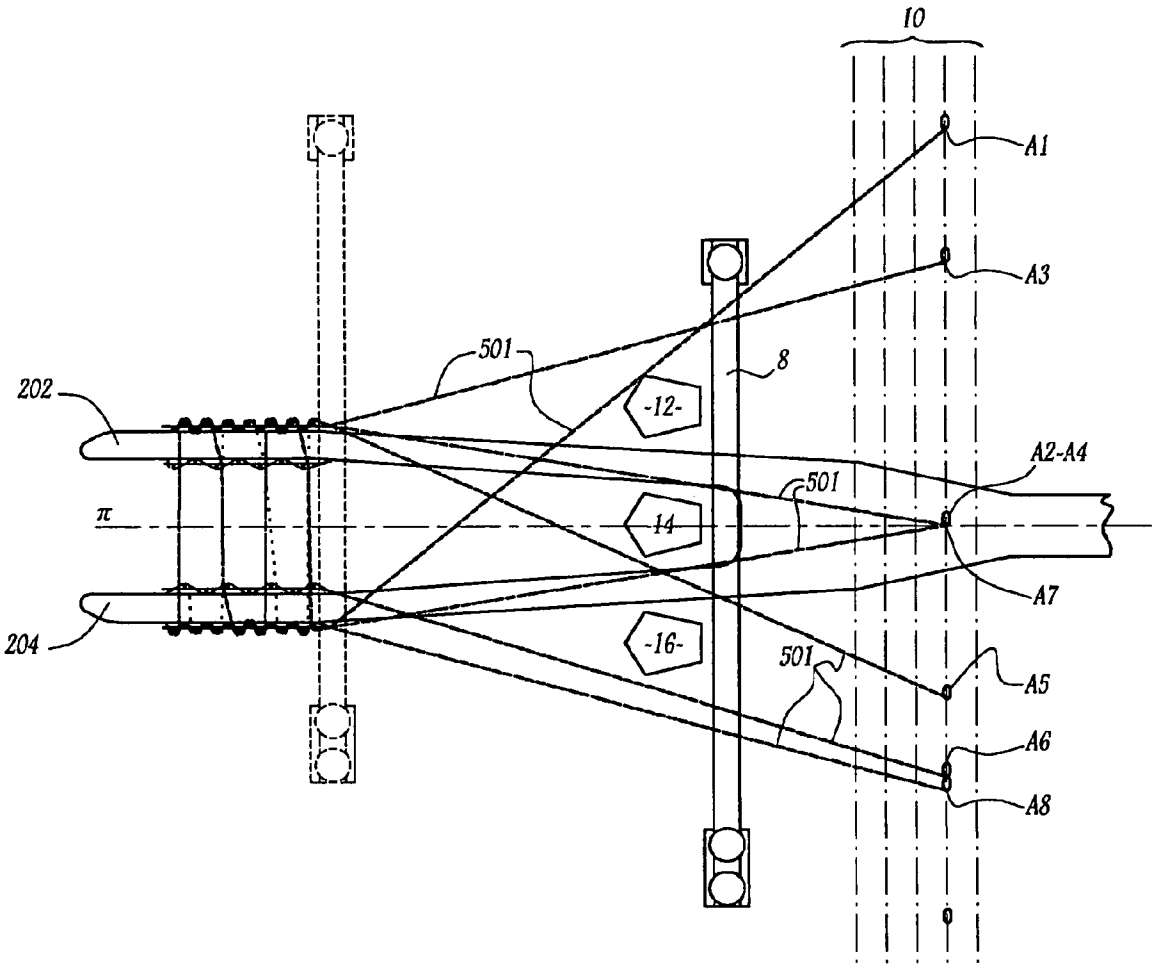
FIG. 3 represents the respective positions taken by some pile warp yarns during weaving.

On FIG. 3, the references A1-A8 show the respective positions of pile warp yarn 501 for the eight first picks P1-P8 represented on FIG. 2. At pick P1, yarn 501 must go above the three weft yarns 301, 304 and 303 respectively inserted in the shed by the rapier sets 12, 14 and 16. Pile warp yarn 501 is then interlaced in the lower back layer BL4 and must be drawn upwardly so that the eyelet of the corresponding heddle takes a first position A1 on FIG. 3. In the following description, the position of the eyelet of the heddle driving a warp yarn is considered as the position of the warp yarn. This position is actually defined by the position of the corresponding heddle frame 10. At pick P2, pile warp yarn 501 must go between weft yarns 301 and 302, that is between rapier sets 12 and 14 so that it takes position A2. At pick P3, pile warp yarn 501 is still interlaced in back layer BL2 and must go above weft yarn 301, that is above rapier set 12, so that it takes position A3. At pick P4, pile warp yarn 501 is still interlaced in layer BL2 and must go between weft yarns 301 and 302, that is between rapier sets 12 and 14, so that it takes position A4 which is the same as position A2. At pick P5, pile warp yarn 501 is interlaced in back layer BL2 and must go between weft yarns 303 and 304, so that it takes position A5. At pick P6, pile warp yarn 501 is interlaced in front layer FL4 and must go under bottom rapier set 16, so that it takes position A6. At pick P7, pile warp yarn 501 is interlaced in back layer BL4 and must go between weft yarns 303 and 304, so that it goes between rapier sets 14 and 16 and takes position A7. Finally, at pick P8, pile warp yarn 501 is interlaced in layer BL4 and must go under bottom rapier set 16 in order to go externally with respect to weft yarn 303, so that it takes position A8. At pick P9, pile warp yarn 501 takes position A1 again and the same pattern as for picks P1 to P8 starts again.

Considering that positions A2 and A4 are identical, seven positions are required to weave pile warp yarn 501 within the respective layers FL2, BL2, FL4 and BL4 of the upper and lower fabrics 42 and 44, according to the shedding pattern represented on FIG. 2.

These seven positions can be programmed thanks to electronic control unit 50 which controls the four servomotors 40 driving the first four heddle frames 10 of loom 2. Those positions are compatible with the pattern which expresses the theoretical position of the warp yarns with respect to the insertion means. They also geometrically allow insertion means to introduce weft yarns without damaging warp yarns.

In order to achieve the above-mentioned positions of pile warp yarn 501, microchip 52 computes, at each pick, the position A1-A8 to be taken by this yarn, actually the position of a heddle frame 10 supporting a heddle which drives this yarn. Data relating to the shedding pattern to be obtained by the set of servomotors 40 is stored in memory 54. On the basis of this data, it is possible for microchip 52 to determine, for each pick, in which layer pile warp yarn 501 has been interlaced in the previous pick, this layer being considered as an "origin layer". This gives the starting point of the line representing the position of yarn 501 on FIG. 3. On the basis of this information relating to the origin layer of the pile warp yarn 501, and on the basis of the shedding pattern to be followed, microchip 52 can determine the position to be taken by pile warp yarn 501, hence the position of the corresponding heddle frame 10. Electronic control unit 50 can then control the corresponding servomotor 40 on this basis, as shown with signals $S_{50}$ on FIG. 1, in order to move each heddle frame towards one of several predetermined positions. This can be done because servomotors can be easily piloted by electronic control unit 50 and reach any position between fixed upper and lower positions.

Actually, if one considers pile warp yarn 501 interlaced in one of layers BL2, FL2, BL4 and FL4, it can take four positions, namely a first position above top rapier set 12, a second position between top and intermediate rapier sets 12 and 14, a third position between intermediate and bottom rapier sets 14 and 16 and a fourth position under bottom rapier set 16. In other words, if N is the number of rapier sets, pile warp yarn 501 originating from one layer can take N+1 positions. Pile warp yarn 501 can be interlaced in either one of layers BL2, FL2, BL4 and FL4 so that it can actually take M×(N+1) positions, where M is the number of layers where pile warp yarn 501 is to be interlaced according to the shedding pattern. In the example represented on the figures, M equals 4.

If a pile yarn is to be interlaced in four layers, its position will have to be selected amongst 4×(3+1)=16 predetermined positions.

Because of the specific pattern represented on FIG. 2, only eight positions A1-A8 are used, and, since positions A2 and A4 are identical, the servomotor 40 driving the frame which moves yarn 401 can be programmed with seven reference positions.

Thanks to the invention, the respective positions A1-A8 of the pile warp yarns can be achieved without interference between these yarns and the insertion zones of the weft yarns. The four frames 10 represented on FIG. 3 allow to obtain four different paths for pile warp yarns, namely yarns 501 and 502 and two non-represented yarns.

Practically, the seven reference positions of the pile warp yarn 501 depend on the weaving pattern, the location of the beating point of the concerned layer and the distance between the heddle and the beating point of the concerned layer. They can be stored in memory 54 of the electronic control unit 50. While weaving, electronic control unit 50 determines at each pick the right position of the heddle amongst the stored reference positions and according to the pattern and the layer in which the warp yarn was previously interlaced. This kind of method allows advantageously changing pattern or geometrical parameters that affect reference positions independently. For example, if the distances between layers are modified, the reference position must be changed in a way that still allows the insertion means to function without damaging the warp yarns.

The same approach can be followed for pile warp yarn 502 and any other pile warp yarn which is not represented and belongs to fabrics 42 and 44. Unlike pile warp yarn 501, pile warp yarn 502 does not goes from top ground part 422 to bottom ground part 442 in a straight vertical way. For example at pick P8, pile warp yarn 502 is placed in position A4 and remains in this position at pick P9 so that inner weft yarn 304 and outer weft yarn 303 are inserted under pile warp yarn 502. In other words, pile warp yarn 502 goes from top ground part 422 to bottom ground part 442 over one pick, that is pick P9. The result is that the pile warp yarn 502 is slightly on the skew.

Once cut, the pile warp yarn 502 will tend to recover a vertical position but be longer than the cut pile yarn 501. This is advantageous in case of artificial turf because the appearance of the carpet will be then closer to natural turf since the piles will have two different lengths, like grass blades. It is also possible to obtain more than two different lengths for the piles of the fabric, by having the pile yarns 501, 502 or equivalent pile yarns following different paths between back layers BL2 and BL4.

Figure 4:
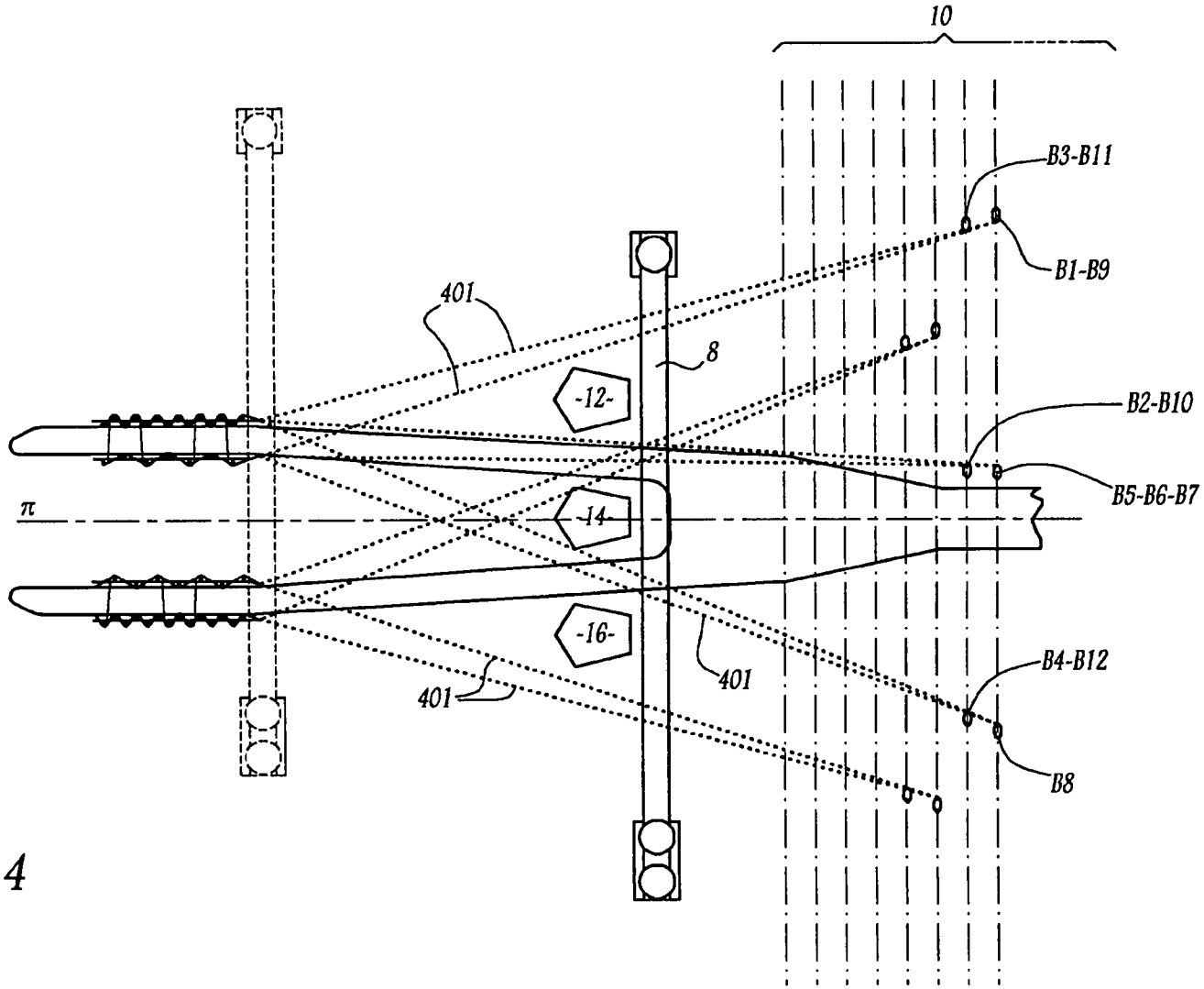
FIG. 4 is a view similar to FIG. 3 showing the respective position taken by the connecting warp yarns during weaving.

As shown on FIG. 4, the fifth to eighth heddle frames, with respect to reed 8, are used to position the connecting warp yarns 401, 402 and other non represented connecting warp yarns, in their respective paths represented on FIG. 2. The connecting warp yarns are woven according to a twelve pick repeat pattern. With the example of connecting warp yarn 401 on FIG. 2, its heddle frame 10 must respectively take the twelve positions B1-B12 represented on FIG. 4. The positions B5, B6 and B7 are the same since connecting warp yarn 401 does not change position between picks P5 and P7. The positions B3 and B11 are the same since the connecting warp yarn 401 is interlaced in the outer layer BL2 and is placed above top rapier set 12 at picks 3 and 11. The positions B1 and B9 are the same since the connecting warp yarn 401 is placed above top rapier set 12 at picks 1 and 9 whereas it was interlaced in the inner layer FL2 at previous picks. The positions B2 and B10 are the same since the connecting warp yarn 401 is placed under top rapier set 12 at picks 2 and 10 without changing of layer. The positions B4 and B12 are the same since the connecting warp yarn 401 is placed under top rapier set 12 and intermediate rapier set 14 at picks 4 and 12 whereas it was interlaced in the outer layer BL2 at previous picks 3 and 11. In other words, six different reference positions are used to weave connecting warp yarns according to the pattern shown on FIG. 2 and loom 2 is designed to provide such positions.

If one considers for example an artificial turf application, the pile yarns 501 and 502 extend from one back layer BL2 to the other BL4 on a distance of about 70 mm and the distance between the back layer and the front layer in each fabric 42 and 44 is about 15 mm. In these conditions, some positions B1-B8 are so close to each other that they can be merged. For instance, positions B1 and B3 can be merged together. The same applies for positions B2, B5 and B6 and for positions B4 and B8. Therefore, the frame moving connecting yarn 401 can be driven with three reference positions.

As for pile warp yarns, the position of the heddle frames driving the connecting warp yarns are determined by electronic control unit 50 on the basis of the layer in which each connecting warp yarn is interlaced in a previous pick and on the basis of the shedding pattern to be followed. However connecting warp yarns are interlaced in two layers which are fed with weft yarns with the help of two rapier sets. Each position is selected amongst 2×(2+1)=6 predetermined positions since any connecting warp yarn can be interlaced in one of layers BL2 and FL2 or BL4 and FL4 and might have to go externally with respect to outer weft yarns 301, and 303, between inner and outer weft yarns or between inner weft yarns 302 and 304.

Figure 5:
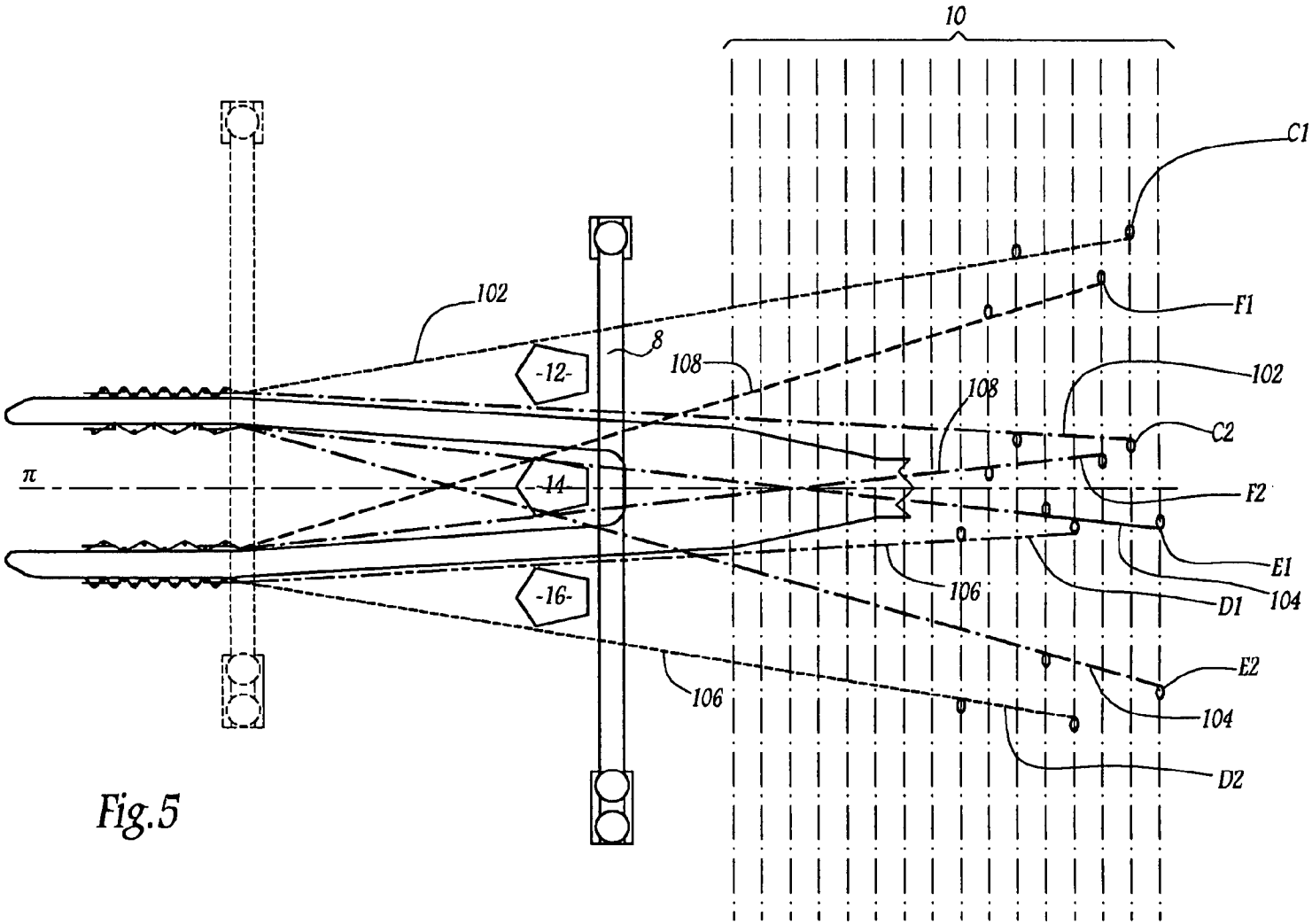
FIG. 5 is a view similar to FIG. 3 showing the respective positions taken by the respective binding and filling warp yarns during weaving.

As shown on FIG. 5, the binding and filing warp yarns are driven by the heddles frames 10 which are further away from reed 8 with respect to the frames guiding the pile and connecting warp yarns. This corresponds to the fact that the amplitude of the vertical displacement of the filing and binding warp yarns is smaller than the amplitude of the movements of the pile and connecting warp yarns. Binding warp yarn 102 takes positions C1 and C2, whereas binding warp yarns 106 takes positions D1 and D2, respectively on either side of top rapier set 12 and bottom rapier set 16. On the other hand, binding warp yarn 104 takes positions E1 and E2 whereas binding warp yarn 108 takes positions F1 and F2, respectively on either side of intermediate rapier set 14.

This can also be achieved with electronically driven electrical servo actuators, similar to motors 40, driven by electronic control unit 50 as explained here-above.

Figure 7:
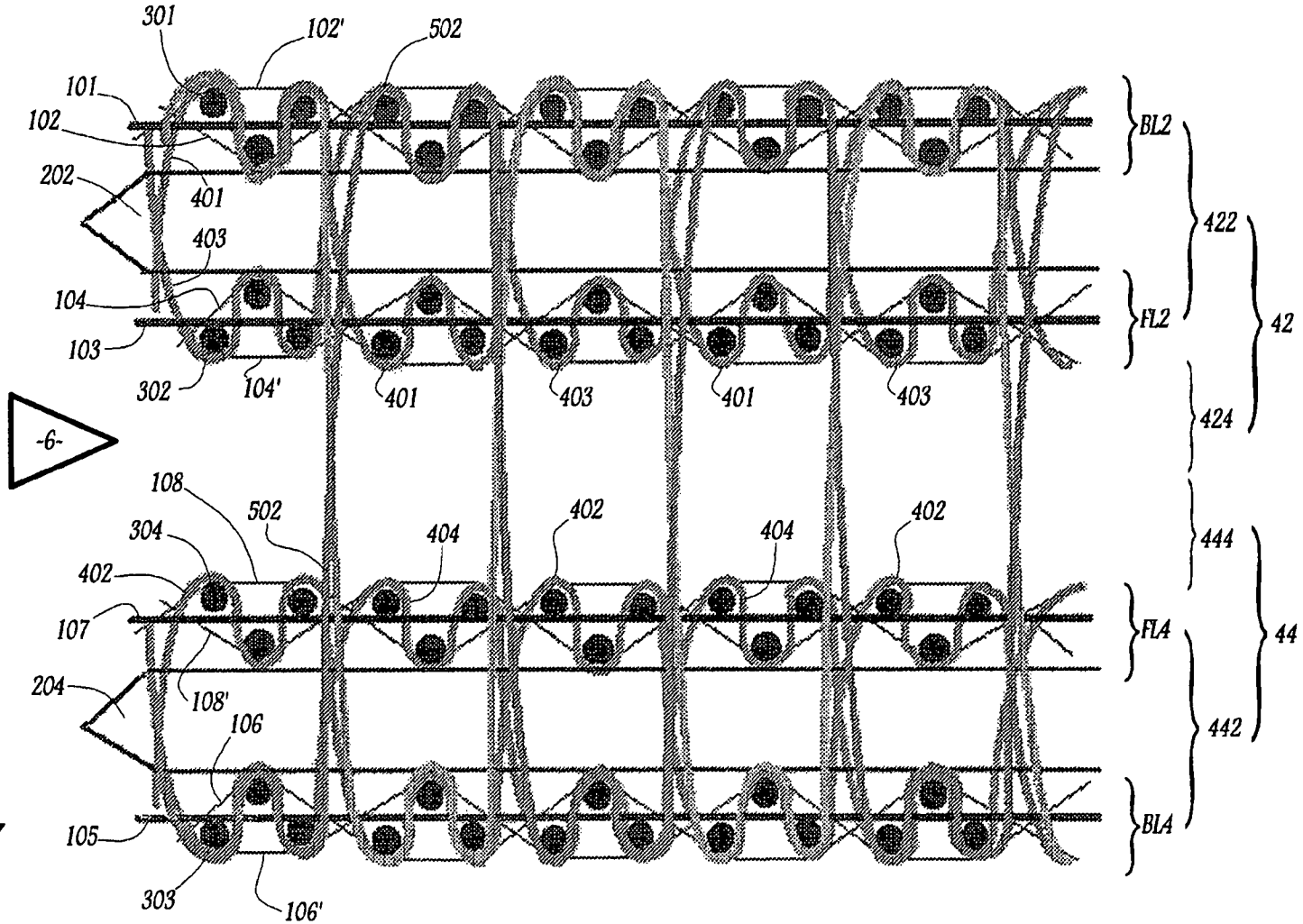
FIG. 7 is a schematic view similar to FIG. 2 for a second embodiment of the invention.

In the second embodiment of the invention represented on FIG. 7, the same elements as in the first embodiment have the same references. In this embodiment, two connecting warp yarns are used in each fabric, namely a first connecting warp yarn 401 and a second connecting warp yarn 403 in fabric 42, and a first connecting warp yarn 402 and a second connecting warp yarn 404 in fabric 44. In this embodiment, one uses a four-rapier sets loom where four weft yarns are inserted within the shed at each pick, one weft yarn 301 in the back or outer layer BL2 of the upper fabric 42, a second weft yarn 302 in the front or inner layer FL2 of the upper fabric, a third weft yarn 303 in the back or outer layer BL4 of the lower fabric 44 and a fourth weft yarn 304 in the inner or front layer FL4 of the lower fabric 44. The connecting warp yarns 401 to 404 are W-inwoven in the respective inner and outer layers FL2, FL4, BL2 and BL4 and are distributed in two sets which cross between inner and outer layers of each fabric between picks P3 and P4 represented on FIG. 7.

Each layer BL2, FL2, BL4 or FL4 of a fabric comprises one filling warp yarn 101, 103, 105 or 107 and two binding warp yarns 102 and 102', 104 and 104', 106 and 106', 108 and 108'. Layers with double binding warp yarns could also be used in the first embodiment and layers with single binding warp yarns could be used in this embodiment.

Moreover, the pile warp yarns 501 and 502 are also W-inwoven in the outer or back layers BL2 and BL4 and cross, from one back layer to the other, at the same picks as the connecting warp yarns go from one layer to the other in one fabric. In other words, the change of layer for a connecting warp yarn 401-404 or a pile yarn 501, 502 takes place simultaneously during the weaving method, so that the connecting warp yarns and the pile yarns extend in the same zone in the volume within each distance fabric 42 and 44.

As in the first embodiment, an electronic control unit drives some servomotors in order to determine, for each pick and for each connecting warp yarn and each pile warp yarn, in which layer this warp yarn has been interlaced in the previous pick. On this basis, and on the basis of the shedding pattern to be followed, the electronic control unit selects, amongst several predetermined positions, a position to be taken by a heddle frame driving the warp yarn.

In this embodiment, the number of layers M equals four, whereas the number of weft insertion means equals four, so that the total number of positions which can be taken by each heddle frame is 4×(4+1)=20 if the controlled warp yarn has to be interlaced in the four layers.

The invention makes it easy to weave sophisticated "three dimensional structures" by simplifying the management of the shedding means. The user simply has to program reference positions whose number depend on how many layers the warp yarn is interlaced in and how many insertion means are necessary to weave those layers. The electronic control unit analyses for each pick the pattern and the origin layer to determine the right reference position to join. The reference positions can be stored in the form of absolute positions or in the form of offsets. Since they depend on geometrical parameters as the distances between layers, the user can change the shed geometry and the pattern independently.

Thanks to electric shedding element which can be programmed to move yarns in every position, unsymmetrical weaving can be achieved. For example, the distances between each inner and outer layers can be different between top and bottom fabrics 42 and 44.

In the examples, the electronic control unit determines for each pick in which layer the warp yarn was previously interlaced. This information could be computed externally by a CAD system from the pattern and stored in memory 54 in the same way as the pattern.

In the same way, a CAD system can entirely compute the right position of the shedding means for each pick. The CAD system provides a file of a succession of reference positions which will be stored in the memory 54 of the electronic control unit 50. In such a case, the CAD system forms a computation means, connected or associated to loom 2 and which selects, for each pick, for each connecting warp yarn and each pile warp yarn and amongst several predetermined positions, a position to be taken by the shedding elements, on the basis of some information relating to the layer in which this warp yarn has been interlaced in the previous pick and on the basis of the shedding pattern. The CAD system fulfills a function similar to microchip 52 mentioned for the first embodiment of the invention.

The invention has been described here-above in the case where warp yarns are moved by heddle frames. It is also possible that some or all warp yarns, in particular pile warp yarns and connecting warp yarns, be connected to harness cords driven by respective servomotors such as disclosed in EP-A-0 933 466.

The invention claimed is:

1. A method for simultaneously weaving on a loom two distance fabrics provided with piles, said method comprising at least the steps of:

weaving an inner layer and an outer layer for each distance fabric;

binding the inner and outer layers with connecting warp yarns extending between the inner and outer layers;

weaving pile warp yarns between the distance fabrics; and cutting the pile yarns;

wherein during weaving, the inner and outer layers of each distance fabric are kept apart by respective lancet means; and for each pick and for each connecting warp yarn and each pile warp yarn, one selects, on the basis of the information relating to the layer in which said warp yarn has been interlaced in the previous pick, on the basis of the shedding pattern and amongst several predetermined positions, a position to be taken by a shedding element driving said warp yarn during said pick, where said warp yarn does not interfere with said weft insertion means.

2. The method according to claim 1, wherein said position is selected amongst a number of possible positions equal to M+(N+1), where M is the number of layers where said warp yarn is to be interlaced according to the shedding pattern and N is the number of weft insertion means used to insert weft yarns into said M layers.

3. The method according to claim 1, wherein connecting warp yarns (401-404) are W inwoven successively in each layer of the distance fabric they belong to.

4. The method according to claim 1, wherein in each distance fabric, connecting warp yarns are divided into two groups of warp yarns which alternate, on the same pick, between the inner and outer layers of said distance fabric.

5. The method according to claim 1, wherein the pile warp yarns extend between the outer layers of said distance fabrics.

6. The method according to claim 5, wherein the pile warp yarns are W inwoven in the outer layer of each distance fabric.

7. The method according to claim 5, wherein some pile warp yarns cross from one distance fabric to the other distance fabric over one pick.

8. The method according to claim 1, wherein the pile warp yarns are divided into two groups of warp yarns which alternate, on the same pick, between the outer layer of the first distance fabric and the outer layer of the second distance fabric.

9. The method according to claim 8, wherein in each distance fabric, connecting warp yarns are divided into two groups of warp yarns which alternate, on the same pick, between the inner and outer layers of said distance fabric and wherein groups of connecting warp yarns and groups of pile warp yarns alternate on the same pick respectively between the inner and outer layers of each distance fabric and between the outer layers of the distance fabrics.

10. A method according to claim 1, wherein three weft yarns are inserted in each pick, in such a way that:

in a given pick, a weft yarn is inserted in the outer layer of each distance fabric and in the inner layer of a first distance fabric, and in the next pick, a weft yarn is inserted in the outer layer of each distance fabric and in the inner layer of the second distance fabric.

11. A loom for simultaneously weaving two fabrics provided with an inner layer, an outer layer, connecting warp yarns extending between said inner and outer layers and pile yarns extending between the fabrics, the loom comprising shed forming means and weft insertion means, wherein:

the loom comprises two sets of lancet means adapted to keep the inner and outer layers of each fabric apart from each other during weaving, and the loom further comprises, or is connected to, computation means adapted to select, for each pick and for each connecting warp yarn and each pile warp yarn, on the basis of the information relating to the layer in which said warp yarn has been interlaced in the previous pick, on the basis of the shedding pattern and amongst several predetermined positions, a position to be taken by a shedding element driving said warp yarn during said pick, where said warp yarn does not interfere with said weft insertion means.

12. The loom according to claim 11, wherein the shed forming means include heddle frames driven by electric servomotors.

* * * * *